US005176447A

United States Patent [19]

Bata et al.

[11] Patent Number: 5,176,447

[45] Date of Patent: Jan. 5, 1993

[54] TURBOMIXER WITH ROTATING INJECTOR FOR MIXING LIQUID

[75] Inventors: János Bata; György Andó; Zsolt Katona, all of Szeged, Hungary

[73] Assignee: Energiagazdalkodasi Intenzet, Budapest, Hungary

[21] Appl. No.: 458,647

[22] PCT Filed: Apr. 28, 1989

[86] PCT No.: PCT/HU89/00017

§ 371 Date: Feb. 2, 1990

§ 102(e) Date: Feb. 2, 1990

[87] PCT Pub. No.: WO89/10185

PCT Pub. Date: Nov. 2, 1989

[30] Foreign Application Priority Data

Apr. 29, 1988 [HU] Hungary ..... 2191/88

[51] Int. Cl.[5] ..... B01F 15/02

[52] U.S. Cl. ..... 366/164; 366/170; 366/180; 366/263; 366/280; 261/25; 261/88; 416/91; 416/92

[58] Field of Search ..... 366/163, 164, 168, 169, 366/171, 172, 177, 178, 174, 175, 180, 262-265, 270, 280, 170; 261/25, 85, 87, 88; 416/20 R, 90 R, 91, 92

[56] References Cited

U.S. PATENT DOCUMENTS

| | | | |
|---|---|---|---|
| 102,481 | 5/1870 | Boone | 366/164 |
| 194,227 | 8/1877 | Earle | 261/87 |
| 489,872 | 1/1893 | Monday | 366/164 |
| 563,100 | 6/1896 | Toops | 261/87 |
| 723,900 | 3/1903 | Murphy | 366/164 |
| 836,717 | 11/1906 | Trent | 366/265 |
| 950,152 | 2/1910 | Gaar | 261/87 |
| 1,268,630 | 6/1918 | Ruth | 261/87 |
| 1,340,517 | 5/1920 | Ashley | 366/265 |
| 1,779,181 | 10/1930 | McDonald | 261/87 |
| 2,592,904 | 4/1952 | Jackson | 366/169 |
| 2,966,345 | 12/1960 | Burgoon et al. | 261/87 |
| 3,066,921 | 12/1962 | Thommel et al. | 261/87 |
| 3,485,484 | 12/1969 | Quinchon | 416/92 |
| 4,051,204 | 9/1977 | Müller et al. | 366/164 |

FOREIGN PATENT DOCUMENTS

| | | | |
|---|---|---|---|
| 81647 | 3/1894 | Fed. Rep. of Germany | 366/169 |
| 961795 | 4/1957 | Fed. Rep. of Germany | 261/87 |
| 2310319 | 9/1973 | Fed. Rep. of Germany | 261/87 |
| 266085 | 7/1929 | Italy | 366/262 |
| 575183 | 4/1958 | Italy | 366/263 |
| 24170 | 5/1982 | Japan | 366/279 |
| 58651 | 12/1946 | Netherlands | 366/169 |
| 995423 | 6/1965 | United Kingdom | 416/91 |
| 1365184 | 8/1974 | United Kingdom | 261/87 |

*Primary Examiner*—Harvey C. Hornsby
*Assistant Examiner*—Mark Spisich
*Attorney, Agent, or Firm*—Handal & Morofsky

[57] ABSTRACT

A mixer is disclosed for absorbing and mixing gases in liquids, or for mixing a liquid with another liquid and/or atomizing a liquid in a gas. The mixer includes an impeller with blades which are bent backward, the blades being surrounded on both sides by a front wall comprising an exhaust opening and a back wall sealing off at least the entire conveying area. A sectional chamber, which is built together with the coaxial hollow main shaft stub, is constructed in the shaft of the impeller and at least two blades are assembled with a pipe for propellant. The inner end of the pipe adjoins a sectional chamber and a nozzle is provided on the outer end. The impeller is closed off with a casing, injectors coaxial with primary nozzles are led through a casing, a mixing nozzle of the injectors is attached on three sides to the casing of the impeller, the front wall and the back wall while connected with a blade on the fourth side. Finally, the main shaft stub is attached to a stationary pipe for the propellant via a rotating connector.

17 Claims, 3 Drawing Sheets

TURBOMIXER WITH ROTATING INJECTOR FOR MIXING LIQUID

This invention relates to a mixer for absorbing gases and steam in liquids and the mixing thereof, as well as for mixing and homogenizing a liquid with another liquid and atomization of a liquid in a gas or steam.

A wide range of installations, which serve the above-noted purposes, can be found in the chemical industry, pharmaceutical industry, water and waste water purification technology, bioengineering, in technology for environmental protection, in fish-hatching and in heating and cooling engineering. Well-known amoung the known solutions are mixers with nozzles, mixing injectors, rotary cleaning brushes, rotating disks, vane-type blades, turbines and other special mixers in which one element not only serves the task of mixing but also the task of introducing gas into the liquid.

As examples of the devices which simultaneously solve the problem of mixing and gas supply, there may be mentioned Hungarian Patent No. 180,647, German Patent No. 2,513,917 and British Patent No. 2,164,576, which can be characterized by the fact that a direct electric drive is provided, the drive motor being located in the liquid space or above it and constructed in a precise manner. As well, they each provide a drive shaft inserted through the wall defining the liquid space, which is extremely expensive way of providing a drive shaft; moreover, when there is a higher liquid pressure, the gas supply requires separate gas pressure step-up means.

It is a well-known fact that, for a given liquid, an increase in the pressure of the liquid results in the capacity of the liquid to absorb gas increasing. For this reason, bubble forming systems, operated with gas pressure step-up means and compressors and provided with nozzles and mixing nozzles, have become widespread. With these systems, through mixing without dead space and absorption can be solved either on a large surface and with numerous nozzles or, with a smaller surface, the height must be greatly increased, and possibly an installation placed quite deep underground will be required. The last characterized solution is known from sewage technology, tower biology and from biological clarification with a deep shaft; these also represent extremely expensive items. Those installations which are currently considered to be up-to-date are quite well-known from the trade literature, as e.g. Wulf Crueger-Annelises Crueger: Biotechnologie (Verlag fur die Landwirtschaft, 1987).

It is an object of the present invention to eliminate the disadvantages of the known installations, i.e. to develop an installation with simultaneous effective mixing which would function with low investment and operating costs and which can be widely used.

Accordingly, the present invention provides a mixer for absorbing or mixing gases in liquids or for mixing a liquid with another liquid and/or for atomizing a liquid in a gas, said mixer comprising: an impeller having vanes which are bent backward and are surrounded by a front wall having an exhaust opening and a backplate, said backplate sealing off a conveying area; a sectional chamber in the shaft of said impeller, said sectional chamber comprising a hollow main shaft stub, at least two vanes and at least two pipes disposed about the axis of said shaft stub, said pipes being purposed to convey propellant, an end of each of said pipes adjoining said sectional chamber and an opposite end of each of said pipes having a primary nozzle, said impeller being sealed off with a casing through which injectors are disposed which are coaxial with said primary nozzles, mixing nozzles of said injectors being attached on three sides to said casing of said impeller, and to said front wall and to said back wall and connected via said vanes on the fourth side, said main shaft stub being attached to a stationary conduit for said propellant via a rotating connector.

The invention is based on the knowledge that by appropriately designing the impeller vanes of a ventilator, or pump with radial overflow and with aid of correspondingly disposed nozzles, a mixer can be created which combines the advantages of rotary mixers and injectors, i.e. a turbomixer having a rotary injector is developed.

A further feature resides in the fact that, as a result of the design of the rotor with vanes which is forcibly connected with the impeller and can be axially shifted on the bar of the suction tube, the turbomixer with the rotary injector forms, in the liquid medium, a shaft generator, in which the rotor with the blades forms the pressure-regulating valve, the brake, and the device is both an underground and aboveground mixer.

Another feature of the invention is that a ventilator or turboblower may be keyed onto the tubular shaft, which adjoins the impeller, on the conduit for the propellant which has been installed as an extension of the main shaft, in such a way that the pressure connection is directly or indirectly connected to the intake port of the turbomixer, as a result of which the structure forms a turbomixer with supercharger and rotary injector.

In an advantageous embodiment of the mixer according to the invention, an intake port surrounds the suction opening to which a suction tube is attached, if required.

In another embodiment of the mixer according to the invention, the intake port is built with a suction pipe.

In a third advantageous embodiment of the mixer according to the invention, the intake port is attached to a slot of the suction tube which is fastened with spacer elements to the propellant conduit.

It is considered advantageous if a rotor with radial vanes, which can be shifted axially, is placed on the casing of the suction tube, said rotor being protected against torsion with a sliding bolt.

In the fifth embodiment of the mixer according to the invention, the conduit for the propellant is surrounded by a coaxially fixed pipe shaft, one end of which is fastened to the impeller and a ventilator-impeller is mounted on the other end; the ventilator-impeller is located in the ventilator housing which is adapted to the suction pipe.

In another advantageous embodiment of the mixer according to the invention, a pipe hub, which is capable of turning independently of the previously noted elements and to which radial vane-type conduits are attached, is located between the main shaft stub and the conduit for the propellant, the vane-type conduits extend through a ring which adapts with a slot to the intake port of the impeller and the suction tube and nozzles are disposed-in an opposite direction to the injectors—at the end of the suction pipe.

In a further advantageous embodiment of the mixer according to the invention, two impellers are disposed coaxially, namely, in such a way that the intake ports are facing one another; the intake ports are attached to the suction tube and/or to the conduit for the propellant via a section which taps the suction tube, the main shaft stubs are attached via a conduit for the propellant.

It is furthermore considered advantageous if the two impellers are coaxially disposed with the intake ports facing one another, a suction tube being attached to the one intake port whose length is shorter than the distance between the two intake ports; the main shaft stubs of the two impellers adjoin a branch section of the conduit for the propellant which is attached to the conduit for the propellant extending over through the suction tube.

In another advantageous embodiment of the mixer according to the invention, the conduit of the propellant and the branch section are connected to one another via a connection rotating outside the suction tube.

Finally, it is advantageous if, in the mixer of the invention, a distributing pipe is attached to the conduit for the propellant and if two horizontal vane-type pipes each for the propellant—on top of one another at right angles—adjoin the pipe and, furthermore, that the main shaft stubs of the impeller, with one horizontal shaft each and with an open exhaust opening, are attached to the two opposite vane-type pipes; the ends of the two additional opposite vane-type pipes of the propellant end in a pipe elbow which is open toward the top and to which a main shaft stub of an impeller with stubs assembled with the suction pipe is attached.

The most important advantage of the turbomixer with rotating injector according to the invention can be seen in the highly effective gas supply which is attained both by the formation of bubbles having a small diameter, which takes place on a large rotating surface, and by repeated turbulence.

A further advantage is seen in that the present invention may be driven indirectly by widely used hydraulic machines which are used for conveying liquid, gas and steam, which, in most cases, can be done from the compressed-air pipe for circulation or recirculation. A rotating shaft and an electrical cable through the walls which limit the liquid and gas space become unnecessary consequently, electric motors and other electrical devices in the mixing areas are not required. As a result of this, it is possible to operate in an open or closed room, under atmospheric pressure, under excess pressure or in a vacuum.

Multiple uses are, moreover, furthered by the fact that the mixer is self-absorbing which enables a significant liquid depth and promotes absorption in this way, it takes place at a higher pressure; furthermore, the mixer functions as an atomizer, spatial variability in the mixing areas is high-grade, the diameter of the vortex, rotating in several levels and easily adjustable, allows the liquid to move without dead space.

The following are possible areas of application oxidation technologies, mixers for the chemical industry, pharmaceutical industry, biotechnological mixers, autoclaves, reactors, fermenting, gas washers, condensers in the energy industry, absorbers, air and liquid coolers, facilities for environmental protection, neutralization, separators, sand traps in hydrology and waste-water clarification, removal of iron and manganese, basins for aeration, ventilation of ponds and rivers, and fish hatching.

Embodiments of the invention will now be described, by way of example, with reference to the accompanying drawings, in which.

Figure 1:
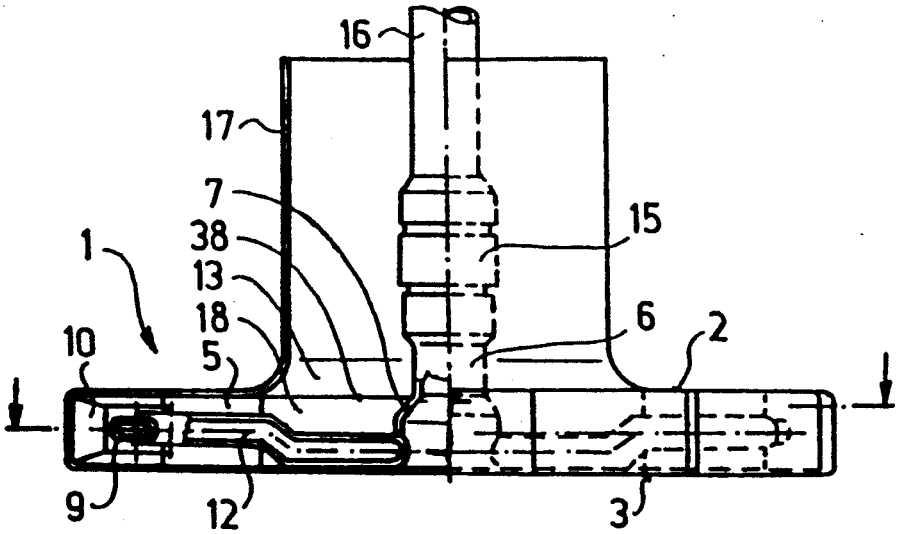
FIG. 1 is a cross-sectional side view of a mixer according to an embodiment of the invention.
Figure 2:
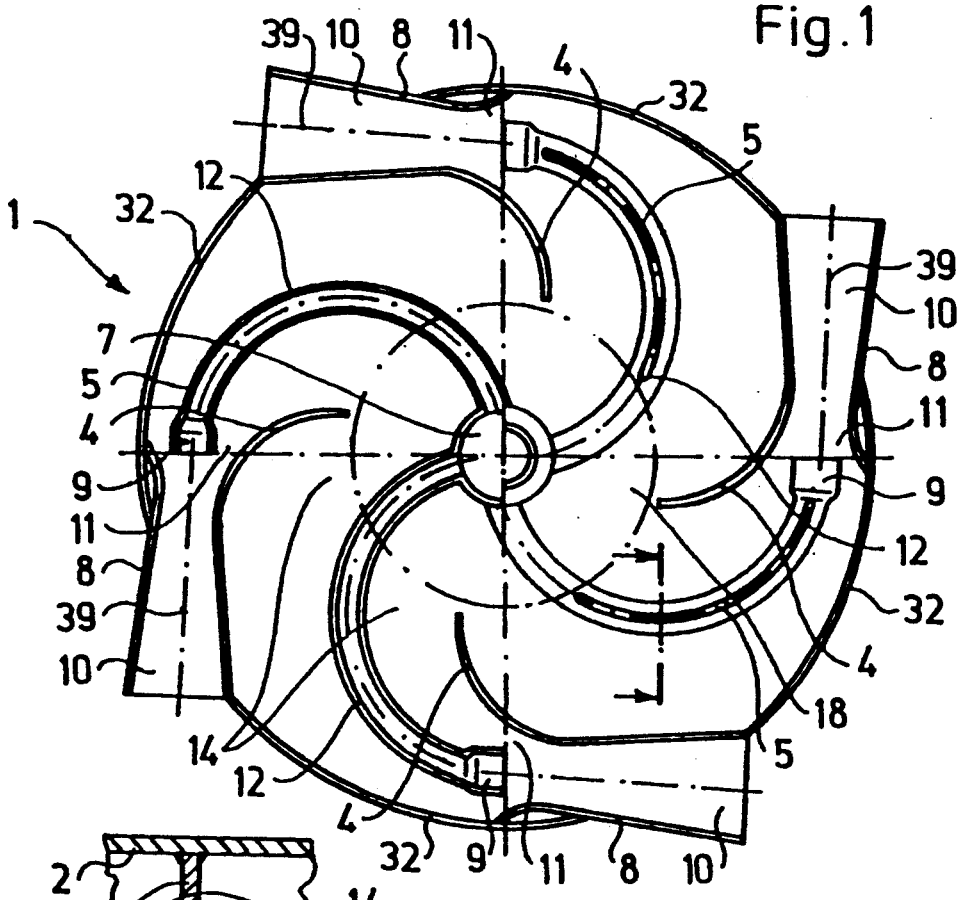
FIG. 2 is a cross-sectional top view of the mixer shown in FIG. 1, taken along the line II—II in FIG. 1.

As can be seen from FIGS. 1 and 2, an impeller 1, which is similar to ventilators with radial overflow or pumps, forms the active part of the mixer.

Radial vanes, bent backward, are placed between a front wall 2 and a back wall 3 of the impeller 1; the design of these blades corresponds to conventional designs. An intake port 38 is provided in the usual manner in the front wall 2 of the impeller 1.

A sectional chamber 7, which is completely closed off from an inlet chamber 18 and a conveying chamber consisting of vane chambers 14, is formed in the middle of the impeller. A pipe 12 of the propellant adjoins the sectional chamber 7. Four are given in the example illustrated here, however, more can also be used. For all intents and purposes, it is advisable to install at least two conduits for balancing of the masses.

Figure 3:
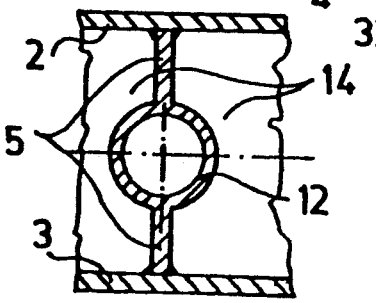
FIG. 3 is a cross-sectional view taken along the line III—III in FIG. 2.

The pipe 12 for the propellant follows the line of each blade. It may be constructed as a single vane section, as can be seen in FIG. 3. Both the conduit 12 and blade 5 are shorter than the radius of the impeller 1, a primary nozzle 9 is provided at the end of the pipe 12 which conveys the propellant. In the present case, this is a slit nozzle, but other nozzle shapes may be used.

An injector 8 is installed in impeller 1, in the shaft 39 of the nozzle 9. Diffuser 10 of the injector 8 extends beyond the periphery of the impeller 1. Impeller 1, between injectors 8, is closed off on the side with a casing 32 of the impeller. A mixing nozzle 11 of injector 8 adjoins casing 32 of the impeller, the front wall 2, the back wall 3 and blade 4. Vane 4 is in no way identical to propellant blade 5, which is integral with the tube for the propellant.

Figure 12:
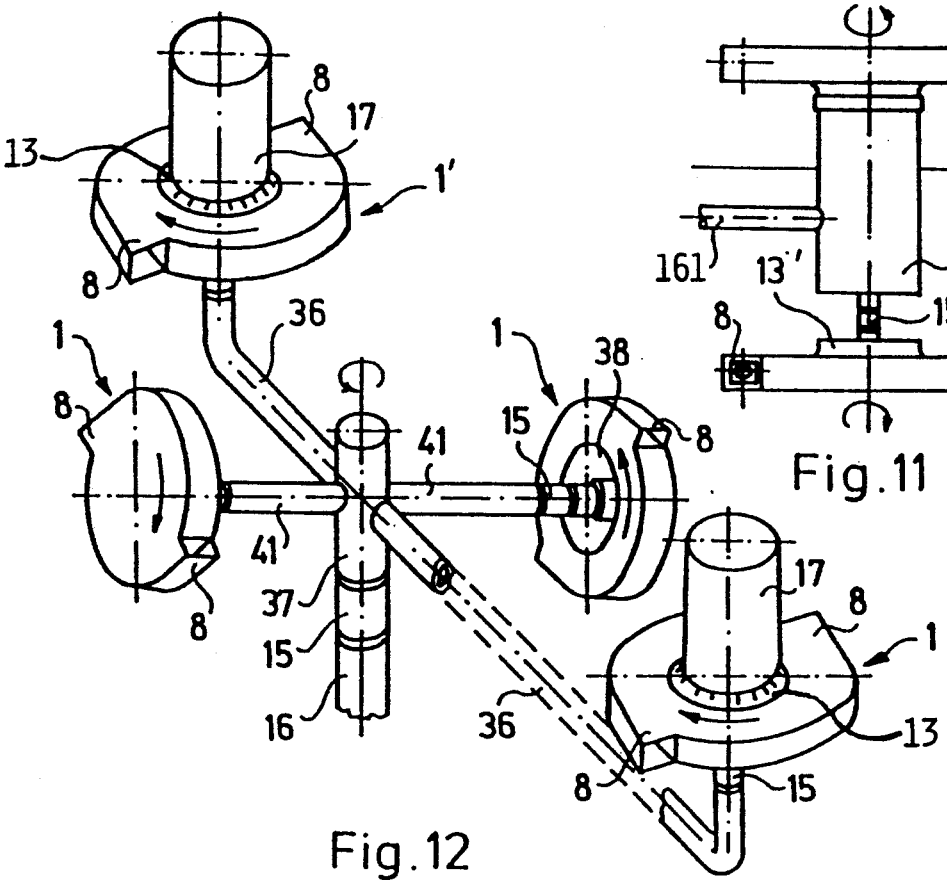
FIG. 12 is a perspective view of a mixer provided with four impellers.

A hollow main shaft stub 6 adjoins sectional chamber 7. As can be seen in FIG. 1, the main shaft stub 6 can be placed on the side facing the front wall 2, in which case the back wall forms the sealing wall of the sectional chamber 7. It is possible to place the main shaft stub 6, as can be seen in FIG. 12, on the side facing the back wall 3, in which case the back wall 3 only seals off the conveyer area of the impeller 1, and so the sectional chamber 7 must be sealed off on the side facing the front wall 2 with a wall which is not shown in the Figure.

The main shaft stub 6 is attached with a rotating connector on a intake conduit 16 of the propellant. The rotating connector, which is not shown in detail here, is constructed in such a way that the main shaft stub is attached to conduit 16 so that it is free from seepage yet also rotatable.

An exhaust connection 13, to which a suction pipe 17 is attached, is installed about the intake port 38 on the front wall 2. In the present case, the suction tube 17 is firmly fixed to the exhaust connection 13.

The mixing process of the above-described turbomixer with the rotating injector will now be described.

The medium arriving under excess pressure via conduit 16 flows through the main shaft stub 6, the sectional chamber 7 and the piping 12 to nozzle 9 and enters injector 8. The torque of the medium flowing through the injector 8 causes the impeller to rotate. The medium flowing into injector 8 carries the medium in the vane chamber along with it. When the impeller 1 now turns, it also functions as a pump and fills the medium conveyed via injector 8 up via suction tube 17. The medium arriving in the vane chamber 14 from suction tube 17 via the inlet chamber 18 can only leave the system via injector 8. In this way, the propellant and the conveyed medium are intermixed in diffuser 10. The almost tangentially issuing mixture produces a vortex about the rotating impeller 1. Impeller 1 and the suction tube 17 rotating with it force the surrounding medium to rotate due to medium friction. The mixing action is increased in this way. Both the propellant and the conveyed medium can likewise be liquid or gaseous.

If impeller 1 is now located in the liquid chamber and the upper edge of suction tube 17 is in the gas chamber, the impeller and suction tube 17 are filled up to the liquid level, in the stationary state, with the given liquid. When started, the propellant begins to draw the liquid off via injectors 8, after which the impeller, after it has been set to rotate, begins to function as a centrifugal pump and is converted to the ventilator operation after the liquid has been removed.

The following description is of additional embodiments of the mixer with rotary injector. Essentially, the operating principle generally corresponds with what has been described above and so only the variations will be described.

Figure 4:
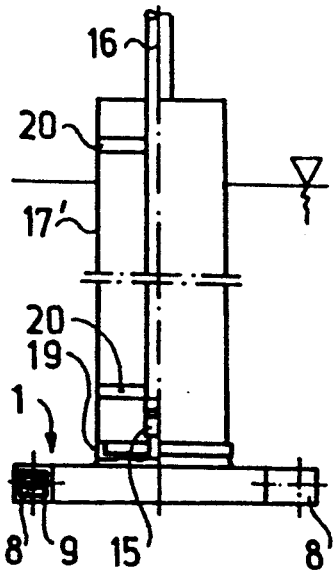
FIG. 4 is an exploded view of another embodiment of the mixer of the present invention.

FIG. 4 shows a mixer which can be expediently used in greater immersion depths. In this embodiment, a suction tube 17' is not fastened to exhaust connection 13 of the impeller, but is instead fastened to conduit 16 via a spacer clamp 20. Suction tube 17' adjoins exhaust connection 13 with an annular slot. The advantage of the thus constructed mixer is that suction tube 17' and intake conduit 16 together have a greater stability.

Figure 5:
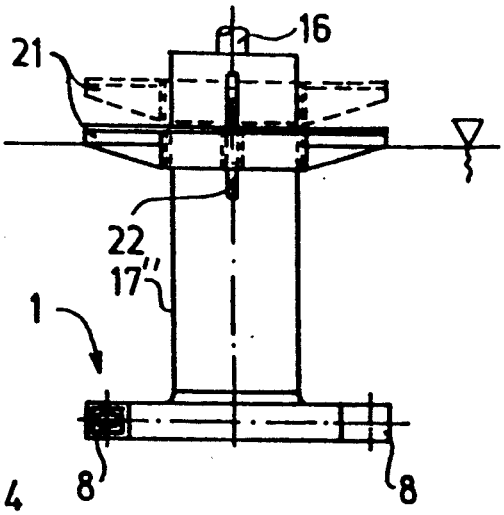
FIG. 5 is a partially cross-sectional side view of a mixer provided with a rotor.

In FIG. 5, a mixer is shown having a suction tube 17" built together with exhaust connection 13. A rotor 21 with radial vane is loosely mounted on the suction tube; said rotor is protected against torque with a sliding bolt. Rotor 21 can be axially shifted on suction pipe 17".

If the rotor 21 is now moved between the end positions, i.e. completely under the liquid level and completely in the gas chamber, the number of revolutions of the impeller will change, even under a constant pressure of the medium flow on intake 16', as a result of which the portion of the moment due to the medium flowing out of injector 8 exerts via the torque, also changes. In this manner, the effective range of the rotating jets increases when decelerated and decreases when accelerated.

In the event that the horizontal dimension of the liquid chamber is shorter, at least on one side, than double the greatest effective range, that number of revolutions can be set, by inserting rotor 21 in the liquid chamber, at which the rotational waves which are produced by the turbomixer with rotary injector and the secondary waves, reflected with the same frequency by the limiting wall, attain the same frequency, whereby the interference produces a wave motion whose movement exceeds the diameter of the impeller. This means that the mixer, consisting of impeller 1 and rotor 21, functions as a hydraulic generator, as a result of which the liquid is dynamically and intensively mixed and moved, and thus, larger amounts of solids can also be moved.

The rotor 21 which is suitable for braking and surface mixing can, of course, be replaced by any mechanical braking device, in which case, when the impeller and the following suction tube 17" are completely suppressed, the injectors are stationary and the range of action is maximum.

Figure 6:
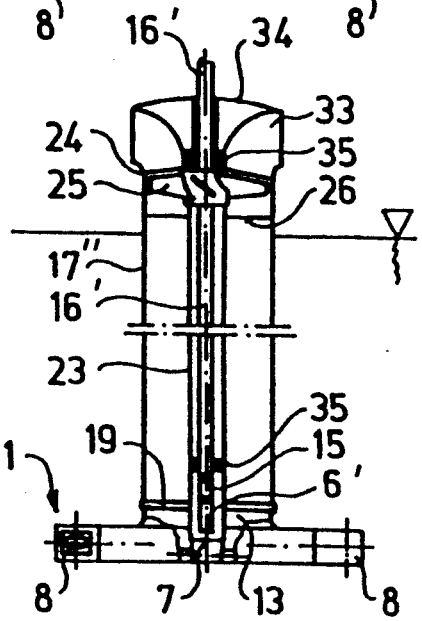
FIG. 6 is a partially cross-sectional side view of a mixer provided with a ventilator.

The mixer shown in FIG. 6 can be successfully used at greater immersion depths.

A pipe shaft 23, which is mounted an intake conduit 16' with bearings 35, is fastened to the main shaft stub 6 of impeller 1. A ventilator impeller 25 is fastened on the other end of the pipe shaft.

Impeller 25 is placed in a ventilator housing 24, whose pressure connections 26 adapt to the suction pipe 17". The guide vanes are located in the housing 24 closed off with a cover 34.

In this embodiment, the suction tube 17" is constructed upright, the height is low, e.g. the ventilator-pressure connection can be directly connected, with a crevice 19, in the closed mixing chamber.

In use impeller 25 of the ventilator follows impeller 1, thus, the conveyed medium is supercharged.

Figure 7:
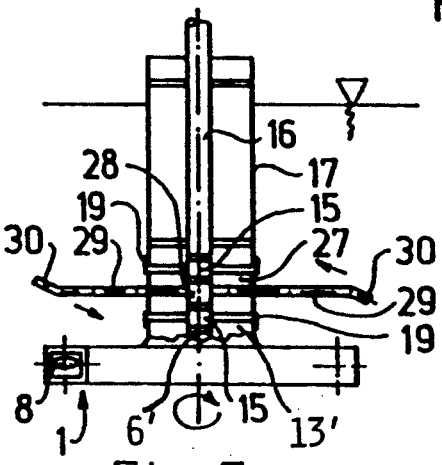
FIG. 7 is a partially cross-sectional side view of an embodiment of mixer provided with a Segner wheel.

In the mixer shown in FIG. 7, a pipe hub 28 is inserted between a modified main shaft stub 6' of impeller 1 and the conduit 16' for the propellant, and said pipe hub can be rotated independently of these. Two vane-type conduits 29, at the ends of each of which a nozzle 30 is mounted, protrude radially from pipe hub 28. Essentially, pipe hub 28, vane-type conduits 29 and further nozzles 30 form a Segner wheel. The direction of the nozzles 30 is opposite the direction of injectors 8.

In order to be able to ensure the free movement of the vane-type conduits 29, a ring 27, having slots 19' through which the vane-type conduits 29 protrude, is inserted between suction tube 17', which is fastened to conduit 16' with spacer clamps 20, and exhaust connections 13'. In the mixer, the Segner wheel functions as follows.

A part of the propellant flowing through conduit 16' issues via pipe hub 28, and reaches the vane-type conduit 29 and further nozzle 30, as a result of which the Segner wheel begins to turn. The path of bubbles from the gas/liquid mixture, which is conveyed by injectors 8, is impinged by the liquid jet flowing out from the nozzle, the bubbles are broken down and, at the same time, carried along onto a path having a larger diameter, i.e. the bubbles have a larger total area in the liquid chamber and a longer period of time is available for absorption. The double ring-shaped whirl of the opposite direction exerts a shearing effect, and turbulence results. Whirls in counterflow are produced.

Figure 8:
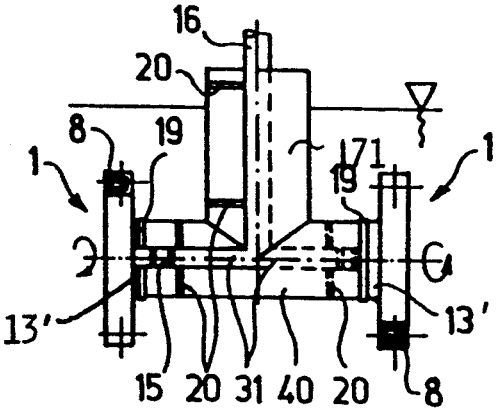

The mixer can be constructed with several impellers. FIG. 8 shows a mixer in which the vertically placed intake conduit 16' for the propellant and an intake conduit 16' for the propellant and a conduit 31 with horizontal axis are connected via a branch section and one impeller 1 each is installed on both ends, in a known manner, with aid of rotating connectors 15'. The exhaust connections 13' adapt to a branch section of a suction pipe 40, the section is assembled with a modified vertically extending suction tube 17'. Suction tube 17' and the section of suction pipe 40 are fastened to conduit 16' and the branch section of conduit 31 of the propellant with spacer clamps. The two impellers 1 can rotate in the same or opposite direction. When turned in an opposite direction, the impellers induce a second whirl, and so the turbulence is increased.

Figure 9:
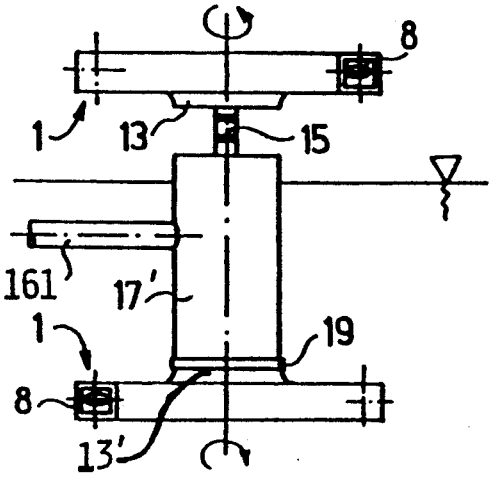
FIGS. 8–11 are side views of various designs of a mixer having two impellers.
Figure 10:
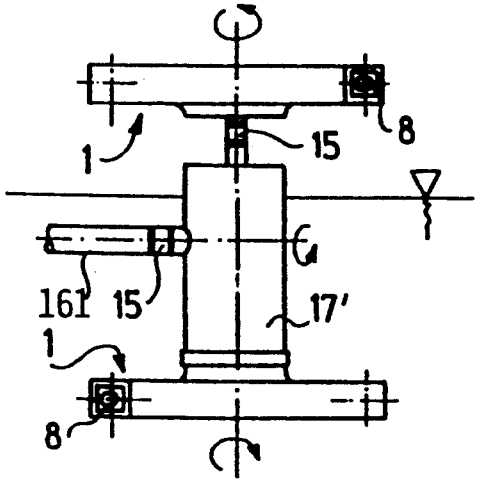
Figure 11:
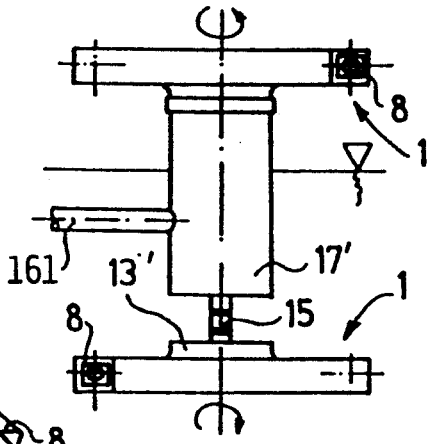

The mixer shown in FIGS. 9–11 is constructed with two impellers. In these embodiments there is a suction tube 17' which is shorter than the distance between exhaust connection 13' of impeller 1 having a vertical axis and which is only adapted to one exhaust connection. A modified conduit 16' for the propellant, which by the way extends horizontally, protrudes beyond suction pipe 17 or it can be firmly fixed or it is possible to divide into a fixed and rotating part outside of suction tube 17 with help of a rotary connector 15.

When the conduit for the propellant is placed completely fixed and impeller 1 is completely immersed in the liquid, to the exhaust connection of which suction tube 17' is attached, the impeller will function in a known manner, whereas the other impeller 1 atomizes the propellant and the conveyed medium drawn in from the surrounding area in form of a mixture on the liquid surface. In this way, the mixer functions as a mixing and atomizing device.

If impeller 1 connected with suction tube 17' of the same mixer is located above the liquid surface, then the liquid is absorbed, mixed with the propellant and atomized, as is advantageous with mixing condensers, while the other impeller 1 carries out the thorough mixing of liquid/liquid.

In the case where the mixer turns relative to conduit 16' for the propellant, the mode of operation is as follows:

Due to greater weight, the impeller 1 is immersed in the liquid whose exhaust connection 13' is connected with suction tube 17', such that there is liquid in impeller 1 and in suction tube 17', and the level corresponds to the liquid surface. While the liquid is completely displaced due to the rotary motion, it is tipped onto the surface by the buoyant force of the liquid. The liquid now flows in at the open end of suction tube 17', as a result of which the impeller is tipped back. Due to the tipping motion, the other impeller 1 is also partially immersed into the liquid; in this way, it now functions as an atomizer, then it blows the mixture of the propellant and the conveyed medium into the liquid.

The number of impellers can be increased, FIG. 12 shows a mixer which has four impellers, each pair having a different function.

A distributing pipe 37 adjoins a vertically extending intake conduit 16 for the propellant via the rotary connector 15, the pipe has two vane-type conduits 36, 41 extending at right angles on top of one another, which are made in pairs.

One impeller 1 each with horizontal axis of rotation is attached via a rotary connector each to two vane-type conduits 41 which convey the propellant; the exhaust opening of said impeller 1 is left completely free, i.e. there is neither an exhaust connection nor an adjoining suction tube. Impellers 1 rotate in opposite directions.

At the end of the other two vane-type conduits 36 there are pipe elbows, opening vertically upward, at which a modified type of impeller 1 is installed whose main shaft stubs are attached to sectional chamber 7 at the back wall 3. Impellers 1 have exhaust connections 13 which are each assembled with a suction tube 17; the impellers rotate in the same direction.

Impellers 1 having a horizontal axis carry out micronmixing of liquid/liquid. Impellers 1 having a vertical axis stir liquid and gas, as already specified. Meanwhile, the entire mixer turns on intake conduit 16, the entire amount of liquid is thoroughly mixed, and as a result macromixing takes place.

As will be apparent from the above embodiments, the mixer according to the invention adapts to a greater variety of tasks. The mixer can be made from metal, synthetic material such as plastic, or a combination thereof using simple technology. Broadly stated, the present invention provides a fluidmedium mixer for mixing a propellant fluid and a conveyed fluid and having an impeller rotatable about an axis said impeller comprising: a) a shaft supporting the impeller on said axis; b) an impeller housing supported on said shaft for rotation about said axis, said housing having a front wall extending across said axis, a backplate axially spaced from said front wall and also extending acoss said axis, a casing defining a sealed fluid-transfer chamber within said housing between said front wall and said backplate; c) a plurality of injectors for said fluids, said injectors having inner ends equipped with mixing nozzles and extending along injector axes to open outwardly of said housing in a cooperative manner whereby a rotational force is exerted on said impeller in response to discharge of said propellant fluid through said injectors, said mixing nozzles being in communication with said fluid-transfer chamber; d) a plurality of primary nozzles, one for each injector, positioned to discharge propellant fluid into said injector mixing nozzles along said injector axes; e) a pressurized fluid propellant supply means communicating with said primary nozzles to supply a propellant fluid thereto at a first and elevated pressure; and f) a conveyed fluid supply means to admit said conveyed fluid to said fluid-transfer chamber at a second pressure below said first pressure; whereby discharge of pressurized propellant through said fluid propellant supply means, said primary nozzles, said mixing nozzles and through said injectors along said injector axes causes said impeller to rotate and draws conveyed fluid from said fluid-transfer chamber and from said conveyed fluid supply means through said mixing nozzles to be mixed with said propellant and discharged through said injectors. While some illustrative embodiments of the invention have been described above, it is, of course, understood that various modifications will be apparent to those of ordinary skill in the art. Such modifications are within the spirit and scope of the invention, which is limited and defined only by the appended claims.

The embodiments of the invention in which an exclusive property or privilege is claimed are defined as follows:

1. A fluid-medium mixer for mixing a propellant fluid and a conveyed fluid and having an impeller rotatable about an axis, said impeller comprising:

a) a hollow shaft defining said axis and supporting the impeller on said axis;

b) an impeller housing supported on said shaft for rotation about said axis, said housing having:

i) a front wall extending across said axis;

ii) a back wall axially spaced from said front wall and also extending across said axis;

iii) a casing defining a sealed fluid-transfer chamber within said housing between said front wall and said back wall;

c) a plurality of injectors for said fluids, said injectors having inner ends equipped with mixing nozzles and extending along injector axes to open outwardly of said housing in a cooperative manner and positioned and oriented to exert a rotational force on said impeller in response to discharge of said propellant fluid through said injectors, said mixing nozzles being in communication with said fluid-transfer chamber;

d) a plurality of primary nozzles each operatively connected to said hollow shaft, one for each said injector, positioned to discharge propellant fluid into said injector mixing nozzles along said injector axes;

e) pressurized fluid propellant supply means communicating with said primary nozzles to supply a propellant fluid through said hollow shaft and to each of said primary nozzles at a first and elevated pressure; and f) conveyed fluid supply means to draw said conveyed fluid into said fluid-transfer chamber at a second pressure below said first pressure by means of suction developed by said rotating impeller;

whereby discharge of pressurized propellant through said fluid propellant supply means, said primary nozzles, said mixing nozzles and through said injectors along said injector axes causes said impeller to rotate and draws conveyed fluid from said fluid-transfer chamber and from said conveyed fluid supply means through said mixing nozzles to be mixed with said propellant and discharged through said injectors.

2. A fluid-medium mixer according to claim 1 wherein said propellant supply means comprises a cylindrical intake conduit which is stationary relative to said rotatable impeller, whereby the pressurized fluid enters said hollow shaft.

3. A fluid-medium mixer according to claim 2 wherein said conduit is attached to a hollow connector which is rotatably mounted on said shaft.

4. A fluid-medium mixer according to claim 3 wherein said shaft opens into a sectional chamber which distributes the pressurized fluid to said primary nozzles.

5. A fluid-medium mixer according to claim 1 wherein said propellant supply means comprises a propellant blade for each primary nozzle, said propellant blade being convexly curved in the direction of rotation of the impeller.

6. A fluid-medium mixer according to claim 5 wherein said propellant blade comprises a pipe connecting the primary nozzles to the hollow shaft to transport the pressurized fluid to said primary nozzle and a divider wall extending between the front wall and the back plate and supporting said pipe.

7. A fluid-medium mixer according to claim 1 wherein said conveyed fluid supply means comprises a suction tube connected to said front wall and adapted to direct conveyed fluid to said fluid transfer chamber, an intake port adjacent the injectors, a plurality of vanes and vane chambers defined between said vanes each associated with each said injector and operatively associated with the fluid transfer chamber, whereby said vane chambers can convey the conveyed fluid to said injector.

8. A fluid-medium mixer according to claim 7 wherein said suction tube extends annularly around said shaft.

9. A fluid-medium mixer according to claim 1 wherein said shaft comprises a stationary conduit, said conveyed fluid supply means comprises a suction tube connected to said front wall and adapted to direct conveyed fluid to said fluid transfer chamber and said suction tube is fastened to said stationary conduit by spacers.

10. A fluid-medium mixer according to claim 9 wherein said suction pipe has one end to which said front wall of the impeller connects and another end remote therefrom, said mixer further comprising a rotor axially slidably mounted to said other end of said suction pipe for rotation therewith, said rotor being provided with radial rotor blades to slow rotation of the impeller when said rotor blades are immersed in liquid.

11. A fluid-medium mixer according to claim 9 wherein said impeller is a primary impeller and said suction pipe has one end to which said front wall of the impeller connects and another end remote therefrom, said mixer further comprising a secondary impeller mounted to said other end of said suction pipe for rotation therewith, said secondary impeller communicating with said suction pipe and being rotatable with said primary impeller to supercharge it.

12. A fluid-medium mixer according to claim 9 including a first rotatable sleeve communicating with said stationary conduit to receive propellant therefrom, a plurality of Segner wheel conduits extending radially from said first rotatable sleeve, and a second rotatable sleeve on said suction pipe permitting said Segner wheel conduits to extend outwardly of said suction pipe, said conduits being rotatable independently of said propellant conduit and said suction pipe and being operatively positioned to interact with said impeller to create a Segner wheel effect.

13. A fluid-medium mixer according to claim 9 wherein said suction pipe and said stationary conduit are branched to provide two impeller-supporting ends, said mixer comprising a pair of said impellers facing one another, one supported on each of said impeller-supporting ends, said propellant supply means of each said impeller communicating with said branched stationary conduit and said conveyed fluid supply means of each said impeller communicating with said branched suction pipe.

14. A fluid-medium mixer according to claim 13 comprising a rotatable connector for said propellant, said rotatable connector being located outside of said suction pipe.

15. A fluid-medium mixer according to claim 9 comprising an impeller having a front wall communicating with said stationary duct and a back wall communicating with said suction pipe.

16. A fluid-medium mixer according to claim 15 having four impellers, two horizontally rotatable, each about a vertical axis, and two vertically rotatable each about a horizontal axis.

17. A fluid-medium mixer according to claim 16 comprising a rotatable distribution head for said propellant supply means, said head having the form of a cross with a first pair of arms extending along a horizontal axis and supporting said vertically rotatable impellers, one on each said arm and a second pair of arms extending transversely of said first pair of arms and terminating in elbows upturned to support said horizontally rotatable impellers.

* * * * *